US005412814A

United States Patent [19]

Pernicka et al.

[11] Patent Number: 5,412,814

[45] Date of Patent: May 9, 1995

[54] PROTECTIVE SPORTS HEADGEAR

[75] Inventors: Martin P. Pernicka, St-Francois; Paul Isabelle; Hubert Gagnon, both of St-Augustin de Desmaures, all of Canada

[73] Assignee: Leader Industries, Inc., Boucherville, Canada

[21] Appl. No.: 231,816

[22] Filed: Apr. 25, 1994

[51] Int. Cl.[6] ..... A42B 1/08

[52] U.S. Cl. ..... 2/424; 2/425

[58] Field of Search ..... 2/410, 411, 421, 422, 2/424, 425, 9, 15, 10, 6.3, 6.4, 6.5, 6.7

[56] References Cited

U.S. PATENT DOCUMENTS

| | | | |
|---|---|---|---|
| 3,400,407 | 9/1968 | Aileo | 2/6.5 |
| 3,601,813 | 8/1971 | Aileo | 2/410 |
| 4,028,743 | 6/1977 | Christensen | 2/424 |
| 4,587,677 | 5/1986 | Clement | 2/424 |
| 4,774,729 | 10/1988 | Coates et al. | 2/424 |

*Primary Examiner*—Clifford D. Crowder
*Assistant Examiner*—Michael A. Neas
*Attorney, Agent, or Firm*—Joseph W. Molasky & Associates

[57] ABSTRACT

The disclosure herein describes a protective sports headgear that comprises a helmet, an intermediate adapter fixed to the helmet and a visor shield hingedly connected to the adapter at opposite sides thereof. A pin mounted on the visor shield engages a locking element on the adapter, the locking engagement being manually releasable allowing the visor shield to be pivotally lifted over the forehead and the top of the helmet. The visor shield also includes an adjustment member enabling various positions of the visor shield relative to the helmet. A chin cup is hingedly mounted to the lower part of the visor shield.

11 Claims, 4 Drawing Sheets

PROTECTIVE SPORTS HEADGEAR

FIELD OF THE INVENTION

The present invention relates to a protective sports headgear having a visor shield which may be manually lifted over a helmet.

DESCRIPTION OF PRIOR ART

Protective headgears are used in many sports such as hockey, football, etc. Such headgears consist of a helmet and a face guard which may be of the transparent plastic visor type or of the rigid metallic grill type.

One known problem with these types of headgears occur when the wearer is not during playing action and wishes to remove the helmet for various reasons, such as ventilation, removal of the pressure exerted by the constricting structure of a helmet, or simply to wipe a perspiring face. One protective headgear may be found described in U.S. Pat. No. 5,093,936 issued Mar. 10, 1992 to Itech Sport Products Inc. However, such equipment is cumbersome in its use since each opposite side of the face guard is provided with a resilient lock element which the user must manually operate to enable him to raise the guard upwardly.

OBJECTS AND STATEMENT OF THE INVENTION

The present invention pertains to an improved protective sports headgear which overcomes the above-described problem and which is easily manually operated by the user. This is achieved by providing a single interlocking arrangement at the front upper region of the gace guard so that the user may single-handedly disengage the locking arrangement and lift the visor upwardly to extend over the helmet.

The present invention therefore relates to a protective sports headgear which comprises, in its broadest aspect, a helmet having a forehead area and top, rear and sides to cover a wearer's head;

an intermediate adapter fixed to the forehead area, the adapter defining a front portion and opposite side portions;

a visor shield hingedly connected to the adapter at the said opposite side portions;

lock engaging means on the visor shield centrally thereof and along the upper edge thereof; and lock means mounted at the front portion of the adapter and cooperating with the lock engaging means on the visor shield; the lock means being manually releasable so that, by disengaging the lock engaging means from the lock means, the visor shield may be pivotally lifted to extend over the forehead area and the top of the helmet.

In one form of the invention, the visor shield comprises, at its opposite side portions, means for adjusting the position of the visor relative to the helmet in order to suit various face configurations of users.

In another form of the invention, the adapter has means cooperating with the visor shield in order to retain it in its lifted position.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
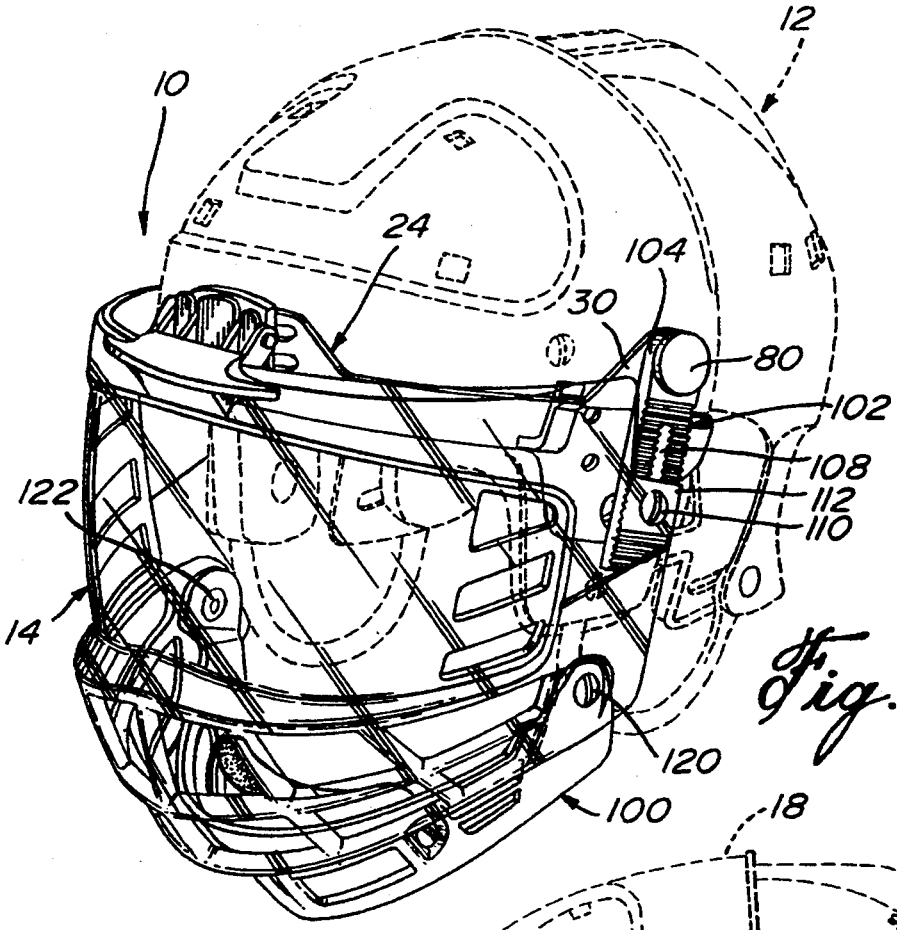
FIG. 1 is a perspective view of a protective sports headgear made in accordance with the present invention.
Figure 2:
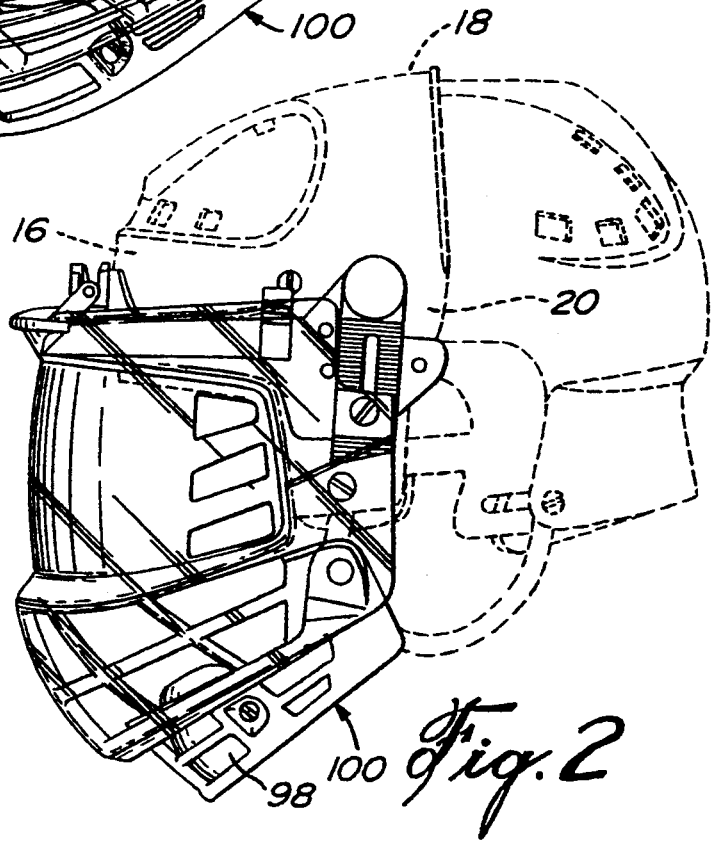
FIG. 2 is a side elevation view thereof.
Figure 3:
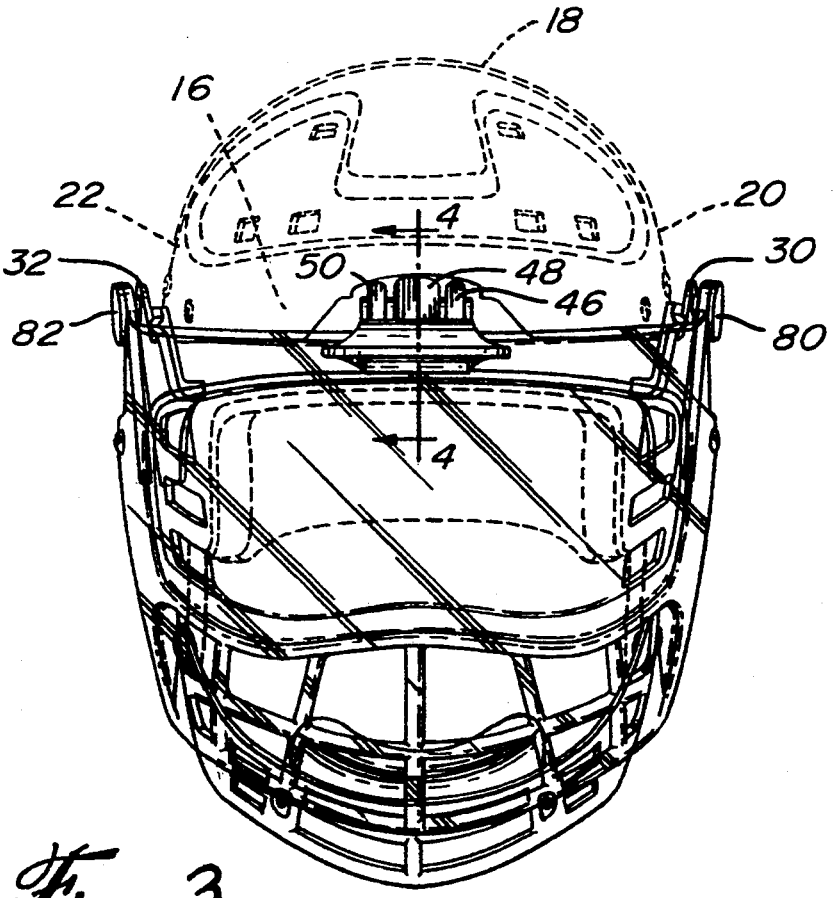
FIG. 3 is front elevation view thereof.

Referring to FIGS. 1, 2 and 3, there is shown a protective sports headgear, generally denoted 10, consisting of a helmet 12 and of a visor shield or face guard 14. The helmet has a forehead area 16, a top 18 and opposite sides 20 and 22. Such helmet is well known and may have various shapes and configurations; the one illustrated in the figures is one which is used most often in the game of ice hockey.

The visor shield 14, made of transparent plastics material, is arch-shaped and extends over the open front portion of the helmet, terminating to the side portions thereof.

Figure 5:
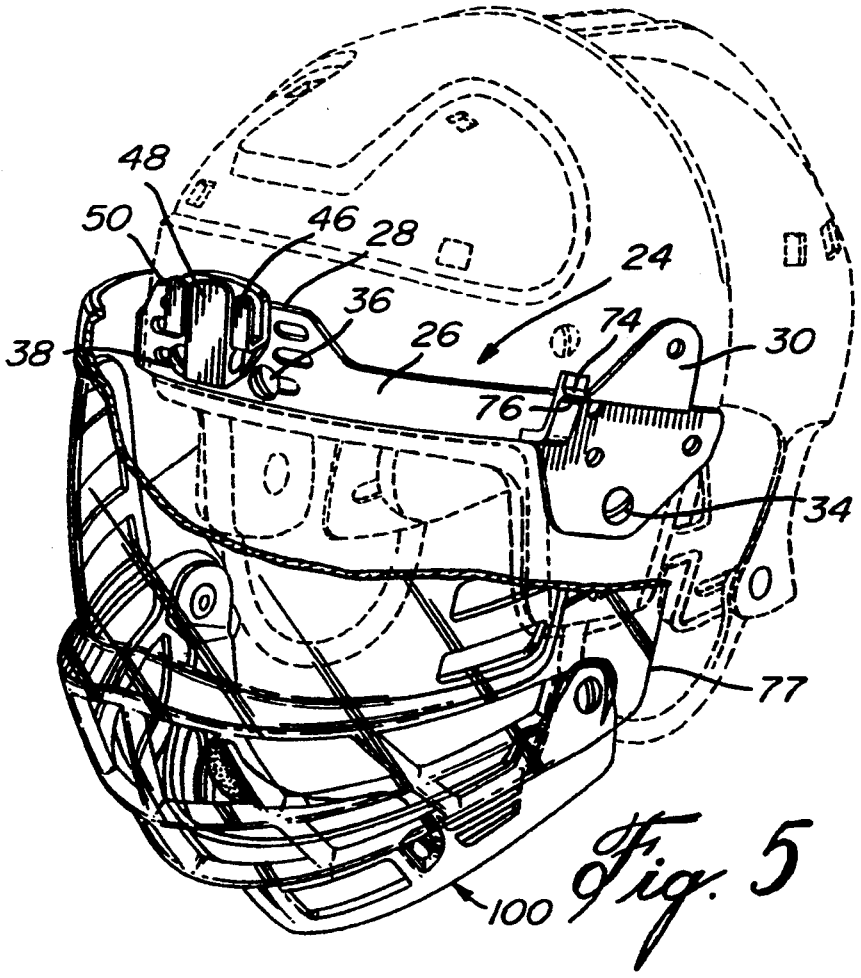
FIG. 5 is a perspective view similar to FIG. 1 with part of the visor shield being broken away to illustrate the adapter.

Referring also to FIG. 5, an adapter, generally denoted 24, is used as an intermediate element between the helmet 12 and the visor shield 14. The adapter 24 includes a flat band portion 26 which follows the contour of the forehead area of the helmet. This adapter has an enlarged central area 28 and two opposite upwardly extending side being portions 30 and 32; it may be provided with a series of holes so as to be fixedly mounted to various types of helmets. Fastening elements, such as screws 34, 36 and 38, secure the adapter to the helmet by engaging corresponding holes in the helmet.

In the central frontal region 28 of the adapter, there is provided a lock device 40 (see FIG. 4) consisting of a rear wall 42 mounted to or integral to the adapter portion 28 and of a front wall formed of three sections 46, 48 and 50. The two opposite sections 46 and 50 each have a rounded bottom recess 52 in registry with one another while the middle section 48 has a lower enlarged bottom recess 53. The middle section 48 also includes a semi-circular recess in its inner wall which is in registry with the recesses of the other two sections 46 and 50. The middle section 48 can be flexed outwardly (such as shown by the dotted line in FIG. 4); this is made possible by a restricted area 56 at the lower recess 53.

Figure 4:
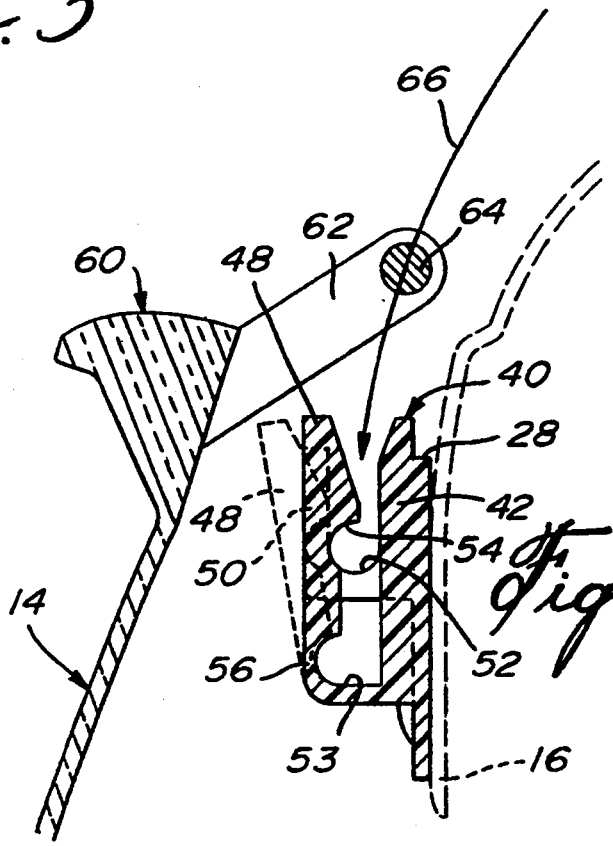
FIG. 4 is a cross-sectional view taken along lines 4—4 of FIG. 3.
Figure 8:
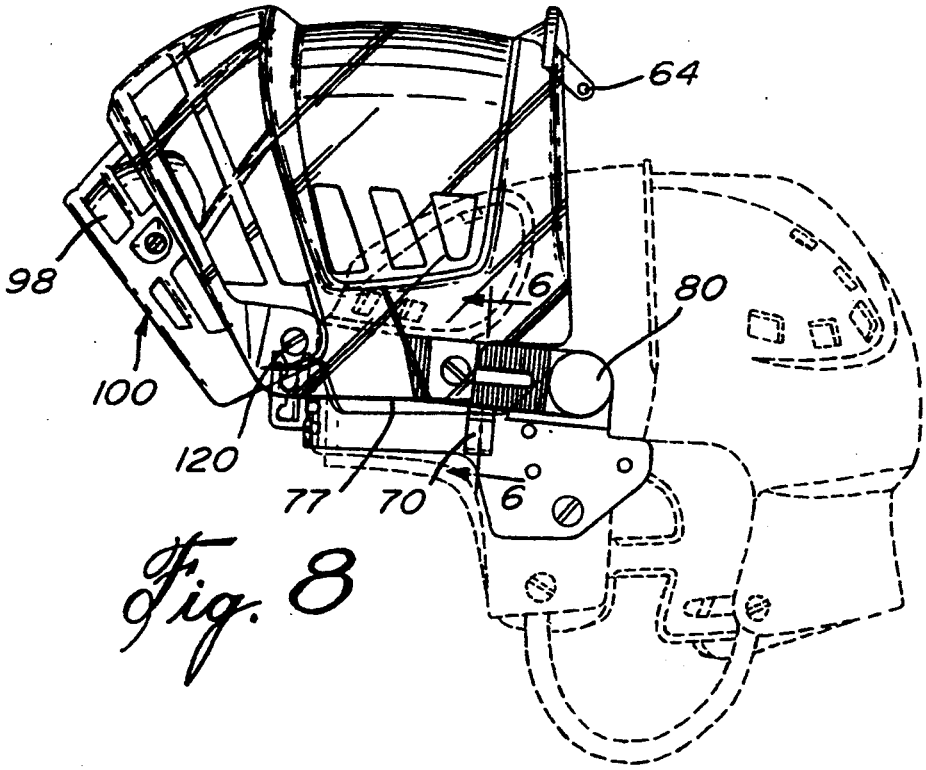
FIG. 8 is a side elevation view showing the visor shield in the lifted position.

Still referring to FIG. 4, the visor shield 14 has a lock engaging portion 60 which may consist of a separate member fixedly attached to the visor shield or which may be an integral part thereof. This locking engaging portion consists of a pair of arms 62 carrying a transverse horizontal pin 64 which, as illustrated by arrow 66, may be slid into the recesses 52 of the lock sections 46 and 50. As it is being inserted, the pin pushes the central section 48 outwardly to thereafter be engaged in the recess 54 and recesses 52. Removal of the pin from this engagement may be easily effected by a simple frontal manual gripping of section 48 allowing the visor shield to be raised upwardly out of the lock device to a position such as illustrated in FIG. 8, that is over the forehead area and top of the helmet.

Figure 6:
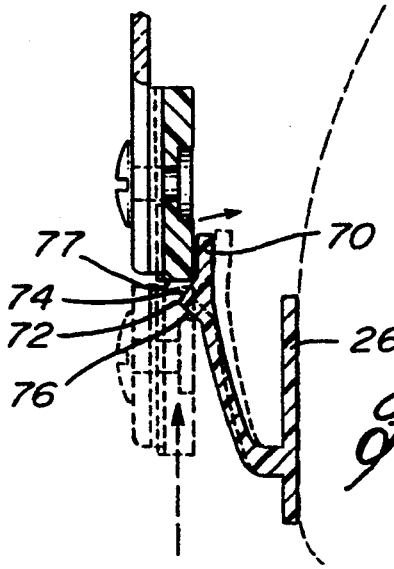
FIG. 6 is a cross-sectional view taken along lines 6—6 of FIG. 8.

FIG. 6 illustrates an outwardly projecting arm 70 fixed to or integrally formed with the adapter 24. This arm displays an outwardly projecting V-shaped portion 72 formed of opposite sloping faces 74 and 76 which are contacted by the side edge area 77 of the visor shield. Hence, when the visor shield is raised such as shown in FIG. 8, the retaining arm 70 serves to hold the visor in its lifted position. On the other hand, the slope of face 74 makes rather easy for the user to return the visor shield to its downward face covering position.

The pivotal movement of the visor shield relative to the helmet is accomplished by hinge elements 80, 82 on opposite sides of the headgear which also secure the visor shield to the adapter side wing portions 30 and 32.

Due to the various face configurations of users, it may be wished to vary the position of the visor shield relative to the helmet for optimum viewing and, in some cases, for the exact locating of a chin contacting device 98 mounted to a frame 100 at the lower part of the visor shield.

Figure 7:
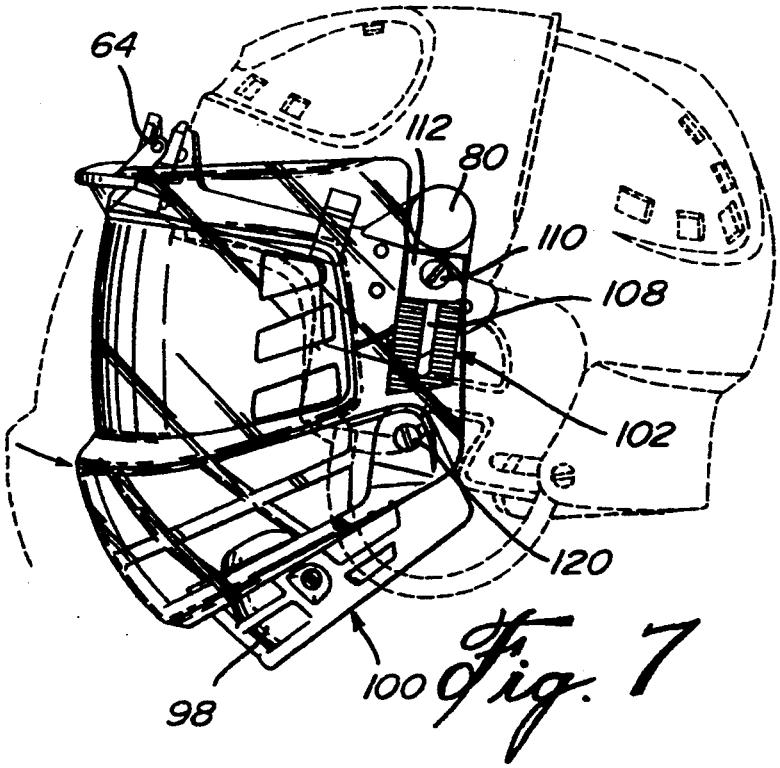
FIG. 7 is a side elevation view showing two positions of the visor shield relative to the helmet.

As illustrated in FIG. 7, the visor shield may adopt various positions between that illustrated in full lines and that illustrated in dotted lines. To achieve this, there is provided an adjustment element, generally designated 102, which has its upper part 104 connected to the side portions 30, 32 of the adapter and secured thereto by means of the hinge elements 80, 82. The adjustment element 102 displays a vertical slot 108 into which is received a fastening bolt 110. This bolt secures a side wing projection 112 of the visor shield to the adjustment element. Untightening bolt 110 allows the visor shield to be moved, i.e. pivoted, about the pin 64 engaged in the locking arrangement described above. When the visor shield is moved downward about pin 64, the bolt 110 slides in the slot 108; once it has reached its lowermost position, the visor shield has the position illustrated by the dotted lines.

This feature is particularly useful when a chin contacting frame 100 is mounted to the visor shield. This frame is hingedly connected at 120 and 122. It is arc-shaped and located inwardly of the arc-shaped lower part of the visor shield. The construction operation of the frame 100 and its chin contacting element 98 is made part of a patent application filed concurrently herewith. The pivotal movement of this frame is limited when the visor shield is in the position shown in FIG. 7, that is when its upper edge contacts the lower part of the visor shield.

The visor shield is also provided with a series of ventilation openings on each opposite side and in its lower part to provide proper maximum cooling for the users during their sport activity.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A protective sports headgear comprising:
a helmet defining a forehead area and top, rear and sides to cover a wearer's head;
an intermediate adapter fixed to said forehead area, said adapter defining a front portion and opposite side portions;
a visor shield hingedly connected to said adapter at said opposite side portions;
lock engaging means on said visor shield centrally thereof and along the upper edge thereof; and
lock means mounted at said front portion of said adapter and cooperating with said lock engaging means on said visor shield; said lock means being manually releasable so that, by disengaging said lock engaging means from said lock means, said visor shield may be pivotally lifted to extend over said forehead area and said top of said helmet.

2. A protective sports headgear as defined in claim 1, wherein said visor shield includes, at said opposite side portions thereof, means for adjusting the position of said visor relative to said helmet.

3. A protective sports headgear as defined in claim 2, wherein said adjusting means include an adjustment element having one end hingedly connected to said adapter and releasable means for securing said visor shield to said element.

4. A protective sports headgear as defined in claim 3, wherein said adjustment element defines a longitudinal slot receiving said securing means therein so as to provide incremental positions of said visor shield relative to said helmet.

5. A protective sports headgear as defined in claim 4, wherein said lock engaging means consist of a pin acting as a pivot point for said incremental adjustment positions of said visor relative to said helmet.

6. A protective sports headgear as defined in claim 1, further comprising means on said adapter cooperating with said visor shield for retaining said visor in a lifted position.

7. A protective sports headgear as defined in claim 1, further comprising a chin engaging device hingedly mounted to opposite sides of said visor shield at a lower part thereof; said device being disposed inwardly of said visor shield at said lower part thereof.

8. A protective sports headgear as defined in claim 7, wherein said lower part of said visor shield defines a lower edge and wherein said device defines an upper edge; said upper edge being so dimensioned as to be limited in its downward hinge movement by contacting said lower edge of said visor shield.

9. A protective sports headgear as defined in claim 8, wherein said device includes a chin contacting cushion element pivotally mounted at a central part of said device.

10. A protective sports headgear as defined in claim 1, wherein said visor shield is made of transparent plastics material.

11. A protective sports headgear as defined in claim 10 wherein said lower part and said opposite side portions of said visor shield include ventilation openings.

* * * * *